US005136918A

United States Patent [19]

Riboloff

[11] Patent Number: 5,136,918

[45] Date of Patent: Aug. 11, 1992

[54] GUITAR PICKUP SWITCHING SYSTEM FOR SELECTING BETWEEN AND WITHIN TWO STANDARD TONALITIES

[75] Inventor: John T. Riboloff, Antioch, Tenn.

[73] Assignee: Gibson Guitar Corp., Nashville, Tenn.

[21] Appl. No.: 642,076

[22] Filed: Jan. 16, 1991

[51] Int. Cl.[5] ..... G10H 3/00; G10H 3/18

[52] U.S. Cl. ..... 84/723; 84/DIG. 7; 84/742; 84/743

[58] Field of Search ..... 84/728, 725, 726, 727, 84/745, 743, 723, 737, 742, DIG. 24, 728, DIG. 7; 200/126, 4, 5 R, 51.02

[56] References Cited

U.S. PATENT DOCUMENTS

| | | | |
|---|---|---|---|
| 3,478,158 | 11/1969 | Trainor . | |
| 3,544,696 | 12/1970 | Broussard . | |
| 3,915,048 | 10/1975 | Stich | 84/728 |
| 4,024,789 | 5/1977 | Humphrey et al. | 84/477 R |
| 4,151,776 | 5/1979 | Stich . | |
| 4,164,163 | 8/1979 | Rhodes . | |
| 4,175,462 | 11/1979 | Simon . | |
| 4,222,301 | 9/1980 | Valdez . | |
| 4,245,540 | 1/1981 | Groupp . | |
| 4,305,320 | 12/1981 | Peavey . | |
| 4,319,510 | 3/1982 | Fender | 84/728 |
| 4,331,060 | 5/1982 | Allen | 84/454 |
| 4,480,520 | 11/1984 | Gold . | |
| 4,581,975 | 4/1986 | Fender | 84/728 |
| 4,711,149 | 12/1987 | Starr . | |
| 4,817,486 | 4/1989 | Saunders . | |
| 4,913,024 | 4/1990 | Carriveau | 84/726 |

*Primary Examiner*—William M. Shoop, Jr.
*Assistant Examiner*—Helen Kim

[57] ABSTRACT

A switching system for an electric guitar using bridge and fingerboard humbucker pickups and a single coil intermediate pickup wherein distinct groups of GIBSON tonality and FENDER tonality can be readily selected. The system uses a two-gang, five position switch for tone selection, the switch employing two, double contacting wipers; and, for mode selection either a toggle or push-pull double pole, double throw switch is utilized.

12 Claims, 2 Drawing Sheets

GUITAR PICKUP SWITCHING SYSTEM FOR SELECTING BETWEEN AND WITHIN TWO STANDARD TONALITIES

BACKGROUND OF THE INVENTION

1. Field of the Invention

The invention relates generally to variable tone electric guitars and, more particularly, but not by way of limitation, it relates to an improved switching system for interchanging the selection and combination of pickup outputs to provide a wide variety of output sounds.

2. Description of the Prior Art

There have been a great number of multi-pickup or multi-coil guitar reproduction systems used and/or attempted in recent years, and it is safe to say that many, if not most of these types of guitar, employ multiple switching and require considerable dexterity and instant recall memory to use in a performance situation. The most efficient of these prior systems have been those that employ a preset wherein certain tonal choices have already been made for the guitar player. Several of these types employ rotary switches; examples include the Willi Stich systems, as owned by the present assignee. The Paul Reed Smith system, and a recent development by Gibson Guitar Corp. that combines a rotary switch in a sophisticated active circuit functioning in conjunction therewith.

While rotary switches are extremely versatile, they are not easy to turn when time is of the essence. Players dislike them also for the reason that they are difficult to read or interpret when the guitar is in use on stage. Another common switching system uses an individual on-off switch, usually a small toggle switch, for each of the three pickups, and coil switching, if necessary, is done by either a fourth toggle switch or by using the three-position switches. In such variations, the center position is "OFF" while a first position is both coils and a third position is a single coil selection. This configuration permits any combination of pickups; however, many of the combinations will require manipulation of two or more switches, often in opposite directions, and this is not an easy movement when it must be effected with great rapidity.

It has long been acknowledged by guitarists and string artists in general that the two most useful guitar pickup configurations are the GIBSON tonality which incorporates two dual-coil humbucker pickups, and the FENDER tonality, i.e., the system used on the STRATOCASTER, which utilizes three spaced single-coil pickups. A modern variation employs three pickups, but uses a dual-coil pickup in the bridge position to enable a more full sound when playing lead parts. Yet another modern variation uses the two humbucking pickups adjacent the bridge and fingerboard but inserts a single-coil pickup between them. The GIBSON system uses a three-position switch that allows the artist to select the fingerboard pickup, both pickups, and the bridge pickup. The FENDER system as originally constructed utilized a three-position switch to select either the fingerboard coil, middle coil or the bridge pickup coil alone There were no intentional combinations of pickups available but such combinations did evolve as the FENDER system was utilized over time.

SUMMARY OF THE INVENTION

The present invention relates to an improvement in guitar switching systems which improvements are directed to a system using one two-position switch and one five-position switch. The guitar employs bridge and fingerboard humbucker pickups and one single coil pickup placed intermediately. The two-position switch MODE presets the main or five-position TONE switch such that in one position of the two-position switch the five-position switch works in the same order as the GIBSON three-position switch and provides selection of GIBSON tonality multiple pickup selections. When the two-position switch is set to the other mode, the five-position switch provides FENDER tonality pickup combinations.

Therefore, it is an object of the present invention to provide a guitar pickup switching system that is more readily controllable in various playing modes.

It is still further an object of the present invention to provide a guitar pickup switching system that is more versatile in operation and offers selection of a wide variety of tonal qualities.

It is also an object of the invention to provide a pickup switch arrangement that is easy and reliable of manipulation to achieve a wide variety of preset tonal outputs.

Finally, it is an object of the invention to provide the full range of tonal qualities that may be likened to either the Gibson "LES PAUL" guitar or the Fender "STRATOCASTER" guitar.

Other objects and advantages of the invention will be evident from the following detailed description when read in conjunction with the accompanying drawings which illustrate the invention.

DETAILED DESCRIPTION OF THE INVENTION

Figure 1:
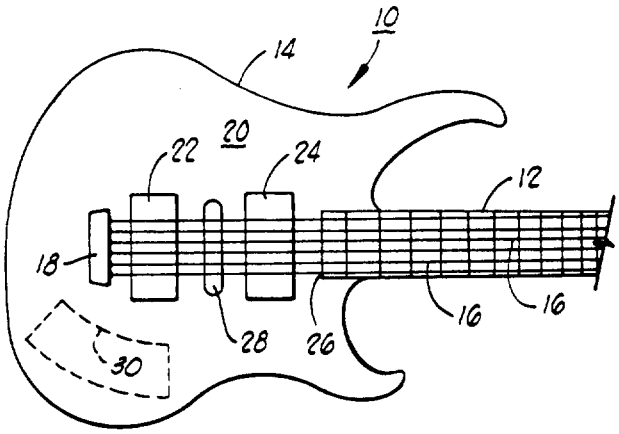
FIG. 1 is a plan view of a guitar body showing the layout of the electrical pickup units.

Referring to FIG. 1, a guitar body 10 is shown with a portion of neck 12 secured on body 14. The guitar 10 includes guitar strings 16 as secured to a bridge 18 and a multiple of pickups are arrayed beneath strings 16 as secured to the face 20 of guitar 10. A dual coil humbucker pickup 22 is secured transversely beneath strings 16 and closely adjacent the bridge 18, a position known as the "bridge pickup". In similar manner, a second dual coil humbucker pickup 24 is secured in spaced, parallel relationship closely adjacent the end 26 of fingerboard 12, and this type of pickup is known as the "fingerboard pickup". A single coil intermediate pickup 28 is then secured intermediate the position of the dual coil pickups 22 and 24. However, a type of humbucker coil might also be utilized in the center position.

The FENDER system employed the three spaced single coil pickups and a control switch that could select either fingerboard, middle or bridge pickup by itself. This switch soon evolved to include certain intended combinations of pickups. The GIBSON system used only the two, spaced dual coil humbucker pickups and allowed switching for selection of the fingerboard pickup, both pickups combined, and the bridge pickup.

Each system has inherent advantages and disadvantages. The GIBSON system is very simple and allows rapid transition from the fingerboard pickup to the bridge pickup, permitting the player to go from chords to lead quickly. A drawback might be its versatility in that only three sounds are easily available. The FENDER system has three combinations of pickup coil that are unavailable on the GIBSON, i.e., fingerboard plus middle coil, middle coil alone, and middle coil plus bridge. However, there is no way to get both fingerboard and bridge pickups together without additional switching.

The single-coil pickups commonly used on FENDER-style guitars have generally lower output but a cleaner sound than GIBSON outputs using the dual humbuckers. There are times when this is useful and times when the player may well want the full GIBSON tonality. The present dual switching controlling the three pickups 22, 24 and 28 will allow the player to get the widest possible variety of sounds with simplest possible switching, a very desirable capability in live stage situations. A dash line area 30 on the lower bout of guitar face 20 outlines a space where control switches and knobs may be located.

Figure 2:
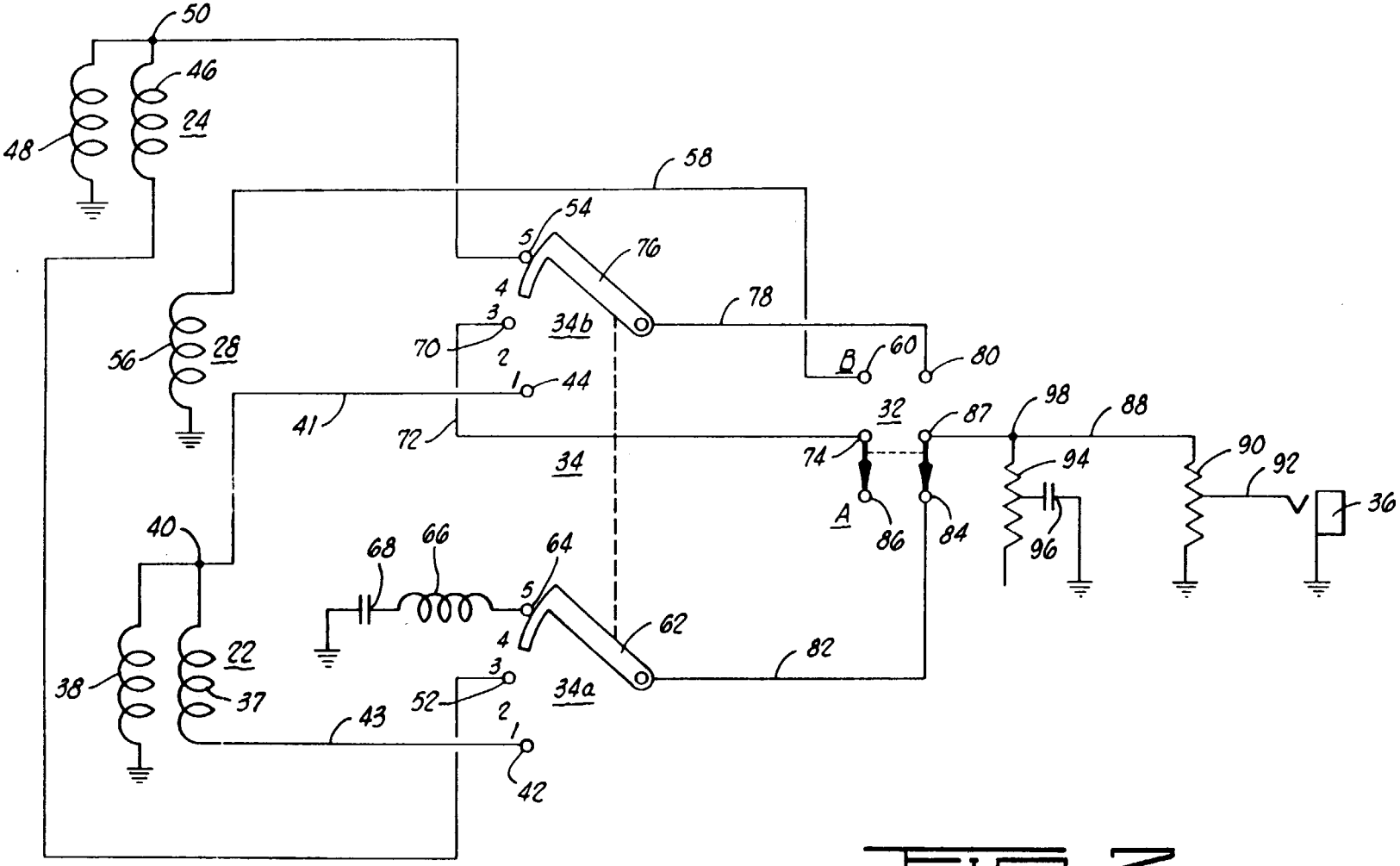
FIG. 2 is a schematic diagram of the electrical pickup and switch structure.

Referring to FIG. 2, there is shown a two-position mode switch 32 and a ganged five-position switch 34 operating into an output jack 36. Output jack 36 may be located on the edge of the guitar body 14 close to the dash line area 30. The two-position switch 32 may be a toggle switch that provides Gibson tonality in the A position and FENDER tonality in the B position. The position switch 34 provides pole output to the B and A contacts of mode switch 32 as selected from the five switch positions interconnected with humbucker pickups 22, 24 and intermediate pickup 28.

The bridge pickup 22 consists of oppositely wound coils 37 and 38 which are interconnected at junction 40 with coil 38 going to ground or common, and coil 36 connected via wire 43 to the No. 1 contact 42 of switch 34*a*. The junction 40 is then connected via wire 41 to the No. 1 contact 44 of switch section 34*b*. The fingerboard humbucker coil 24 consists of oppositely wound coils 46 and 48 as joined at junction 50 with coil 48 going to ground and coil 46 going to a No. 3 contact 52 of switch section 34*a*. The junction 50 is then connected to a No. 5 contact 54 of switch section 34*b*. Intermediate pickup 28 consisting of single coil 56 is connected between ground and lead 58 to the B position mode switch contact 60.

A wiper arm 62 of switch section 34*a* is connected to a No. 5 switch contact 64 which, in turn, is connected through a coil 66 and series-connected capacitor 68 to ground. The L/C tone circuit, coil 66 and capacitor 68, are tuned to roll off low frequency components from the fingerboard pickup, i.e., switch position No. 5. In switch section 34*b*, a central contact 70, the No. 3 contact, is connected via lead 72 to a wiper contact 74 of two position MODE switch 32.

A wiper 76 of switch section 34*b* provides output signal via lead 78 to a contact 80 of mode switch 32, and output on lead 82 from switch 34*a* wiper 62 is connected to a mode switch contact 84, a second mode contact 86 remaining open.

Finally, pickup output signal is present at a pole contact 87 and output lead 88 to a ground-connected resistor 90 that provides a tapped voltage signal output 92 to the output jack 36. An R/C filter connection to ground is made by means of the tapped resistor 94 and grounded capacitor 96 as connected at a junction 98.

Figure 3:
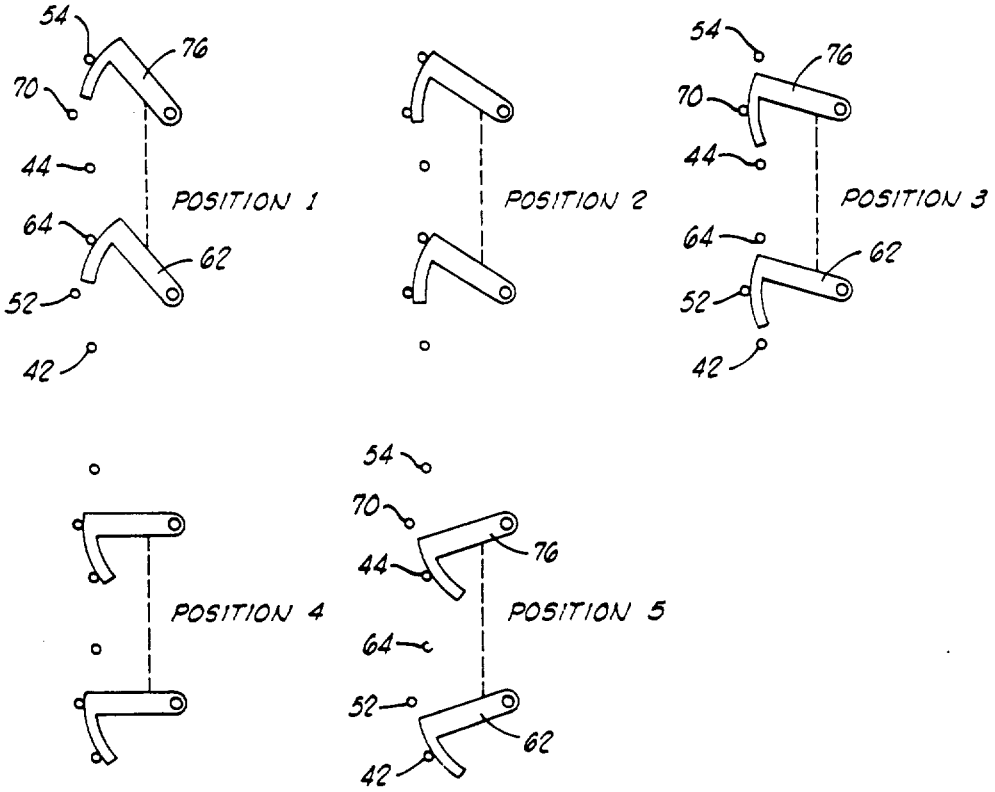
FIG. 3 is a depiction of the tone selection switch and double wiper in each of its five positions.

The mode switch 32 is a double pole, double throw switch and may be either a toggle switch or a push/pull switch. For very fast action, the push/pull type of switch would probably be preferred. The position switch 34 is a double pole, five position rotary switch. The five-position switch 34 utilizes connections at each of switch positions 1, 3 and 5 with no connection to the 2 and 4 positions. Switch 34 may be thought of as a five detent, three contact switch as each of the wipers 76 and 62 includes a wide spanning contact capable of touching two adjacent switch position contacts. This arrangement tends to enable a wide variety of interconnections in both the A and B modes, and FIG. 3 illustrates the wiper/contact arrangement for each switch position of switch 34, i.e., both switch gangs or sections 34*a* and 34*b*. Thus, as shown in FIG. 3, the five-position switch wiper has the capability of contacting either a single or two adjacent switch contacts as it rotates through the five positions. Tone selection is as follows:

| Mode A - GIBSON Tonality | |
|---|---|
| Position | Combination |
| 1 | Bridge pickup 22, both coils |
| 2 | Bridge pickup 22 and fingerboard pickup 24, all coils (four) |
| 3 | Fingerboard pickup 24, both coils |
| 4 | Fingerboard pickup 24 with additional tone circuit 66/68 |
| 5 | Off (standby) |

| Mode B - FENDER Tonality | |
|---|---|
| Position | Combination |
| 1 | (Bridge pickup) single coil 38 |
| 2 | (Bridge pickup) single coil 38 and middle pickup 28 |
| 3 | Middle pickup 28 |
| 4 | (Fingerboard pickup) single coil 48 and middle pickup 28 |
| 5 | (Fingerboard pickup) single coil 48 |

Thus, the switch positions as configured in FIG. 3 allow the player to select any of nine separate sounds with a minimum of complication. With basic preset of the mode switch to Mode A or Mode B, the player has the GIBSON tonality as well as the FENDER tonality within command. Each of these individual tonality sounds is grouped as they were in original instrumentation in an order that the player is accustomed to using and, therefore, confusion is minimized as speed and reliability are emphasized.

Changes may be made in combination and arrangements as heretofore set forth in the specification and shown in the drawings; it being understood that changes may be made in the embodiments disclosed without departing from the spirit and scope of the invention as defined in the following claims.

What is claimed is:

1. Guitar pickup switching apparatus for control of a fingerboard dual coil humbucker, an intermediate single coil pickup and a bridge dual coil humbucker, comprising:

a pickup output jack;

a two position switch with a pole contact connected to the output jack and each of first and second positions connected to receive a respective one of a GIBSON tonality input and a FENDER tonality input;

a two pole, five position switch interconnected with the fingerboard dual coil humbucker, the intermediate single coil pickup and the bridge dual coil humbucker, with said two poles providing a selected one of five tonality signals for input to said two position switch as said GIBSON tonality input and FENDER tonality input.

2. A switching apparatus as set forth in claim 1 wherein: said two position switch is a toggle type switch.

3. A switching apparatus as set forth in claim 1 wherein: said two position switch is a push-pull type switch.

4. A guitar pickup system, comprising:

a dual coil bridge humbucker;

a single coil intermediate pickup;

a dual coil fingerboard humbucker;

first switch means interconnected with each of said bridge and fingerboard humbuckers and intermediate pickup to provide first and second five position outputs indicative of GIBSON and FENDER tonality, respectively, and second switch means interconnected between the first switch means to select one of said first and second five position outputs.

5. A guitar pickup system as set forth in claim 4 wherein said first switch means comprises:

a dual pole switch having first and second gangs of five contacts each.

6. A guitar pickup system as set forth in claim 5 wherein:

said second switch means is a toggle type switch.

7. A guitar pickup system as set forth in claim 4 wherein:

said second switch means is a toggle type switch.

8. A guitar pickup system as set forth in claim 4 wherein:

said second switch means is a push-pull type switch.

9. A string pickup system for stringed instrument having bridge, body face and fingerboard, comprising:

a first pickup that is a dual coil humbucker with center tap as secured adjacent the guitar bridge;

a second pickup that is a single coil and secured intermediate the bridge and fingerboard;

third pickup that is a dual coil humbucker with center tap as secured adjacent the guitar fingerboard;

a two pole, five position tone switch having first and second gangs of contacts with respective first and second dual contact wipers;

a two pole, two position mode switch, having first and second mode wipers and having first and second mode contacts for GIBSON tonality and third and fourth mode contacts for FENDER tonality:

means connecting the first pickup between common and the first gang, first position of the tone switch, and connecting the center tap to second gang, first position of the tone switch;

means connecting the second pickup between ground and the mode switch fourth mode contact;

means connecting the third pickup between common and the first gang, third position of the tone switch, and connecting the center tap to the second gang, fifth position of the tone switch;

means connecting the tone switch second wiper to the third mode contact;

means connecting the tone switch second gang, third position to the first mode wiper;

means connecting the tone switch first wiper to the second mode contact; and means connecting the second mode wiper to an output jack.

10. A string pickup system as set forth in claim 9 which is further characterized to include:

an L/C filter of selected resonance connected between common and the first gang, fifth position of the tone switch.

11. A guitar pickup system, comprising:

a dual coil bridge pickup.

a single coil intermediate pickup;

a dual coil fingerboard pickup;

a multi-pole, multi-position tone switch having first and second gangs of contacts and first and second ganged wipers sequentially movable through at least five consecutive positions;

a multi-position mode switch connected to said tone switch, said mode switch having an output; and means for interconnecting said bridge pickup, said intermediate pickup, said fingerboard pickup, said tone switch and said mode switch so that in response to said mode switch being in a first position the following coil combinations are connected to the output of said mode switch in Gibson guitar player accustomed sequential order in response to moving said tone switch through three of said five consecutive positions: at a position (1) both coils of said bridge pickup, at a position (2) all coils of said bridge pickup and said fingerboard pickup, and at a position (3) both coils of said fingerboard pickup; and further so that in response to said mode switch being in a second position the following coil combinations are connected to the output of said mode switch in Fender guitar player accustomed sequential order in response to moving said tone switch through said five consecutive positions: at the position (1) one coil of said bridge pickup, at the position (2) one coil of said bridge pickup and the coil of said intermediate pickup, at the position (3) the coil of said intermediate pickup, at a position (4) one coil of said fingerboard pickup and the coil of said intermediate pickup and at a position (5) one coil of said fingerboard pickup.

12. A guitar pickup system as set forth in claim 11, further comprising an L/C tone circuit connected to said tone switch so that in response to said mode switch being in said first position and said tone switch being in the position (4) said L/C tone circuit and both said coils of said fingerboard pickup are connected to the output of said mode switch.

* * * * *